US011409321B2

(12) United States Patent
Carton

(10) Patent No.: US 11,409,321 B2
(45) Date of Patent: Aug. 9, 2022

(54) JOYSTICK

(71) Applicant: CROUZET AUTOMATISMES, Valence (FR)

(72) Inventor: Hervé Carton, Valence (FR)

(73) Assignee: CROUZET AUTOMATISMES, Valence (FR)

( * ) Notice: Subject to any disclaimer, the term of this patent is extended or adjusted under 35 U.S.C. 154(b) by 0 days.

(21) Appl. No.: 17/294,205

(22) PCT Filed: Nov. 11, 2019

(86) PCT No.: PCT/FR2019/052678
§ 371 (c)(1),
(2) Date: May 14, 2021

(87) PCT Pub. No.: WO2020/099771
PCT Pub. Date: May 22, 2020

(65) Prior Publication Data

US 2022/0011807 A1 Jan. 13, 2022

(30) Foreign Application Priority Data

Nov. 15, 2018 (FR) ..... 1860532

(51) Int. Cl.
*G05G 9/047* (2006.01)
*G05G 5/05* (2006.01)

(52) U.S. Cl.
CPC ..... *G05G 9/047* (2013.01); *G05G 5/05* (2013.01); *G05G 2009/04707* (2013.01);
(Continued)

(58) Field of Classification Search
CPC ..... G05G 9/047; G05G 2009/04707; G05G 2009/04722; G05G 2009/04733;
(Continued)

(56) References Cited

U.S. PATENT DOCUMENTS 3,394,611 A 7/1968 Beurrier
4,333,360 A * 6/1982 Simmons ..... G05G 5/05 403/114

(Continued)

FOREIGN PATENT DOCUMENTS

DE 9105251 U1 10/1991
DE 102015102317 A1 8/2016

(Continued)

OTHER PUBLICATIONS

International Search Report for International Application No. PCT/FR2019/052678, dated Mar. 12, 2020, 6 pages with English translation.
International Written Opinion for International Application No. PCT/FR2019/052678, dated Mar. 12, 2020, 9 pages with English machine translation.

(Continued)

*Primary Examiner* — Daniel D Yabut
(74) *Attorney, Agent, or Firm* — TraskBritt

(57) ABSTRACT

A joystick comprises an articulation comprising bearing faces that are shaped to permit, via shape-shape interaction when they rub against each other, a rotational movement of a handle. A first set of springs exerts, on the handle, a first vertical force that pushes the bearing faces against each other. A second set of springs exerts, on the handle, a second vertical force in the opposite direction to the first vertical force and the amplitude of which is between $0.9|F_1|$ and $1.1|F_1|$, wherein $|F_1|$ is the amplitude of the first vertical force. The first and second sets of springs are able, in the absence of external stress on the handle, to maintain a non-zero clearance between all the bearing faces of the articulation.

9 Claims, 2 Drawing Sheets

(52) U.S. Cl.
CPC ..... *G05G 2009/04755* (2013.01); *G05G 2505/00* (2013.01)

(58) Field of Classification Search
CPC ..... G05G 2009/04755; G05G 2009/04744; G05G 2009/04751; G05G 2009/04777; G05G 2009/04796; G05G 5/05; G05G 2505/00
See application file for complete search history.

(56) References Cited

U.S. PATENT DOCUMENTS

| | | | | | |
|---|---|---|---|---|---|
| 5,349,881 | A * | 9/1994 | Olorenshaw | G05G 9/047 74/471 XY | |
| 6,118,086 | A * | 9/2000 | Isikawa | G05G 9/047 200/6 A | |
| 2011/0163957 | A1 | 7/2011 | Jaouen | | |

FOREIGN PATENT DOCUMENTS

| | | | | |
|---|---|---|---|---|
| EP | 949555 | A2 * | 10/1999 | G05G 9/047 |
| EP | 1031905 | A2 * | 8/2000 | G05G 9/047 |
| EP | 1640842 | A2 | 3/2006 | |
| EP | 2386831 | B1 | 1/2015 | |
| EP | 2341410 | B1 | 9/2015 | |
| FR | 2912232 | A1 | 8/2008 | |
| FR | 2954980 | B1 | 2/2012 | |
| GB | 2331850 | A | 6/1999 | |
| JP | H8227316 | A | 9/1996 | |
| WO | WO-9009565 | A * | 8/1990 | G01D 5/34 |
| WO | WO-2019084505 | A1 * | 5/2019 | G01B 7/30 |

OTHER PUBLICATIONS

Text Intended for Grant for European Patent Application 11150137, now EP2341410 B1 (issued Sep. 9, 2015), European Patent Office (May 22, 2015), 50 pages with English machine translation.

* cited by examiner

JOYSTICK

CROSS-REFERENCE TO RELATED APPLICATIONS

This application is a national phase entry under 35 U.S.C. § 371 of International Patent Application PCT/FR2019/052678, filed Nov. 11, 2019, designating the United States of America and published as International Patent Publication WO 2020/099771 A1 on May 22, 2020, which claims the benefit under Article 8 of the Patent Cooperation Treaty to French Patent Application Serial No. 1860532, filed Nov. 15, 2018.

TECHNICAL FIELD

The disclosure relates to a joystick.

BACKGROUND

Known joysticks comprise:

a fixed body, a handle that extends, along an axis called the "axis of the handle," from an upper portion to a lower portion that is accommodated inside the fixed body, the upper portion being accessible from outside the body and allowing the handle to be rotated between a neutral position and an inclined position, the neutral position being the position of the handle in the absence of external stress on the handle, and an articulation comprising a male portion and a female portion, one of the male portion and of the female portion being fastened with no degree of freedom to the lower portion of the handle, and the other of the male portion and of the female portion being fastened with no degree of freedom to the fixed body.

The male and female portions comprise corresponding and facing bearing faces, these bearing faces being shaped to permit, via shape-shape interaction when they rub against each other, a rotational movement of the handle about one or more axes of rotation that are fixed with respect to the body and perpendicular to the axis of the handle.

The handle comprises a first rim that is integral with the handle, this rim having, on each side of the handle, an upper face that is turned toward the upper portion of the handle and a lower face that is turned toward the lower portion of the handle.

The joystick comprises a first set of springs that is interposed between the fixed body and the upper face of the rim, this first set of springs comprising one or more springs that are uniformly distributed around a vertical axis, this vertical axis being coincident with the axis of the handle when the handle is in the neutral position. This first set of springs is arranged so as to exert, on the handle, in its inclined position, a mechanical moment that urges the handle toward its neutral position and, at the same time, a first vertical force, parallel to the vertical axis, that pushes the bearing face that is integral with the handle toward the bearing face that is integral with the body.

Such joysticks are for example disclosed in DE9105251U1 or DE102015102317A1.

To reduce the wear of joysticks, it is desirable to limit as much as possible friction between the bearing faces of the articulation of the joystick.

BRIEF SUMMARY

Embodiments of the disclosure aim to solve the aforementioned problem by providing a joystick in which the friction exerted on the bearing faces of the articulation is limited. To this end, it relates to a joystick according to claim 1.

Embodiments of this joystick may comprise one or more of the features of the dependent claims.

BRIEF DESCRIPTION OF THE DRAWINGS

The disclosure will be better understood on reading the following description, which is given solely by way of non-limiting example, with reference to the drawings, in which.

In these figures, the same references have been used to designate the same elements. In the remainder of this description, features and functions that are well known to those skilled in the art are not described in detail.

DETAILED DESCRIPTION

Section I: Examples of Embodiments

FIGS. 1 to 4 show a joystick 2 comprising a handle 4 and a fixed body 6.

Figure 1:
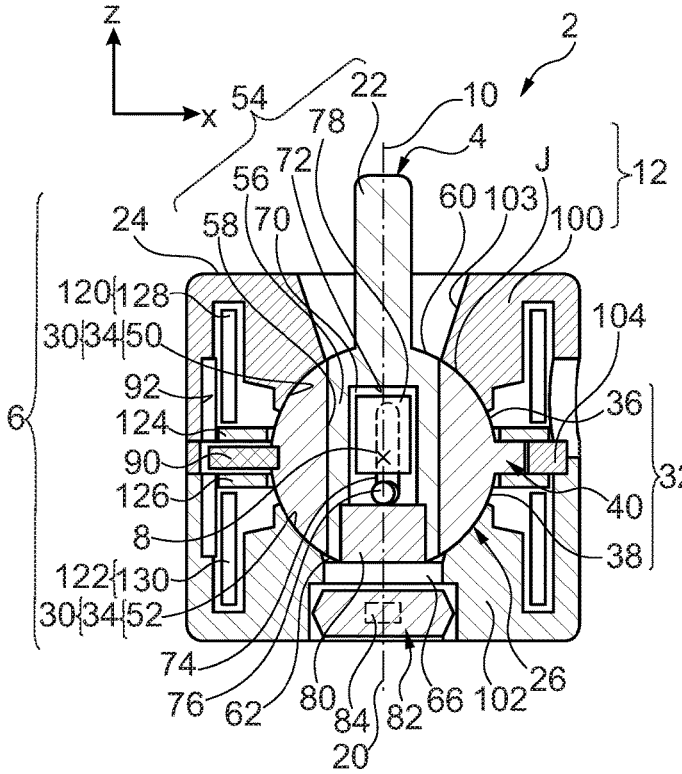
FIG. 1 is a schematic illustration in vertical cross section of a joystick.
Figure 3:
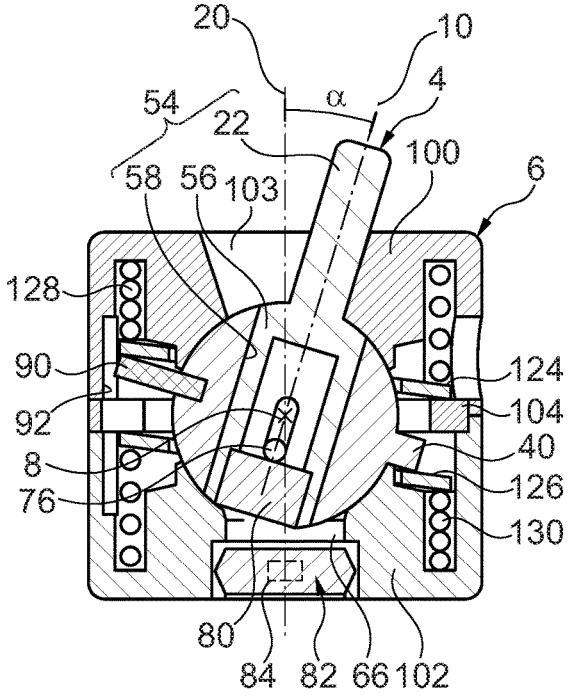
FIGS. 3 and 4 are schematic illustrations, in vertical cross section, of the joystick of FIG. 1 in various positions.
Figure 4:
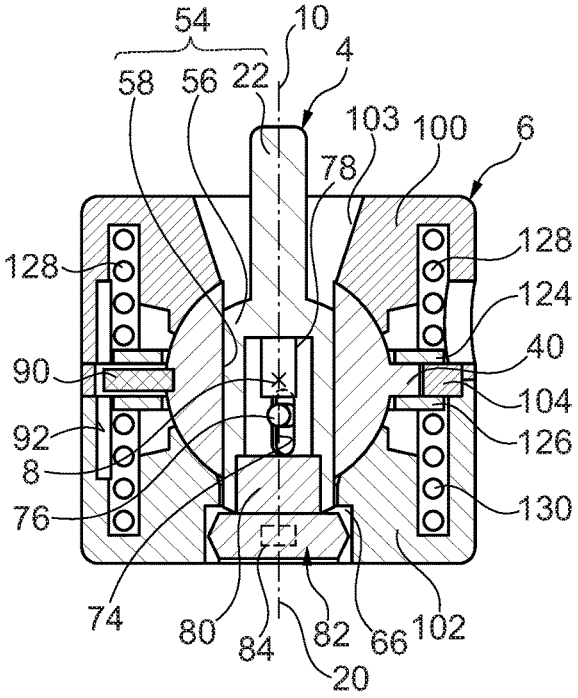

The handle 4 is rotatable, about a center 8 of rotation, between a neutral position, which is shown in FIGS. 1 and 4, and an inclined position, which is shown in FIG. 3. The neutral position corresponds to the angular position that the handle 4 occupies in the absence of external stress, and therefore when the handle 4 is not being manipulated by a user. The user is a human being.

The handle 4 mainly extends along an axis 10 from an upper portion 12 to a lower portion 14. Typically, the axis 10 passes through the center 8.

In this embodiment, in the neutral position, the axis 10 is coincident with a vertical axis 20. The axis 20 is fastened with no degree of freedom to the body 6. In the figures, the vertical direction has been identified by a Z-direction of an orthogonal coordinate system X, Y, Z. The X- and Y-directions are horizontal and perpendicular to each other. Here, the Y-direction is perpendicular to the plane of the paper. Terms such as "upper," "lower," "above," "below," "top," and "bottom" and the like are defined with respect to the Z-direction. The position of the handle 4 corresponds to the angle $\alpha$ (see FIG. 3) between the axes 10 and 20.

The upper portion 12 comprises a gripping means that allows the user to move the handle 4 by hand between its inclined position and its neutral position. For example, the upper portion 12 comprises a shaft 22 that protrudes beyond the upper horizontal face 24 of the body 6.

In this embodiment, the handle 4 is able to pivot about all the horizontal axes passing through the center 8. To this end, the handle 4 is mechanically linked to the body 6 by means of an articulation 26.

The articulation 26 forms a ball joint permitting every possible rotational degree of freedom about the center 8 and no translational degree of freedom. By "no translational degree of freedom" what is meant is the fact that the maximum amplitudes of the translational movements along the X-, Y- and Z-directions are negligible. A translational movement is considered to be negligible if, for example, its amplitude is lower than 5 mm and, preferably, lower than 2 mm or 1 mm.

The articulation 26 comprises a male portion 28 and a female portion 30. The male portion 28 is fastened with no degree of freedom to the lower portion 14 of the handle 4. In contrast, the female portion 30 is fastened with no degree of freedom to the body 6. The male portion 28 is accommodated inside the female portion 30.

The male portion 28 comprises a bearing face 32 that faces a corresponding bearing face 34 of the female portion 30. The bearing faces 32 and 34 are shaped to permit, via shape-shape interaction, only rotational degrees of freedom of the handle 4. To this end, the bearing faces 32 and 34 are formed by segments of first and second spheres that are centered on the center 8 in the neutral position, respectively.

Here, the bearing face 32 is divided into an upper segment 36 and a lower segment 38. The segments 36 and 38 are symmetric with respect to a horizontal plane passing through the center 8 when the handle 4 is in its neutral position. The segment 36 corresponds to the strip of a sphere located between two parallel and horizontal planes that cut this sphere above its center. The center of this sphere is coincident with the center 8. Typically, the distance between these two horizontal planes is larger than 2 mm or 3 mm. The diameter of the sphere is, for example, in a range between 5 mm and 10 cm and, generally, close to 10 mm.

Here, the segments 36 and 38 are separated from each other by a circular rim 40. The rim 40 is centered on the axis 10 and completely encircles the axis 10. The rim 40 mainly lies in a plane that is perpendicular to the axis 10 and that passes through the center 8. This rim 40 has an upper face 42 (FIG. 2) and a lower face 44 (FIG. 2) that are parallel to each other. In the neutral position, the faces 42 and 44 are horizontal. In this neutral position, the face 44 is symmetric to the face 42, with respect to a horizontal plane passing through the center 8. The face of the rim 40 that links these faces 42 and 44 is, for example, vertical in the neutral position.

Correspondingly, the face 34 of the female portion 30 is divided between an upper segment 50, which is located facing the segment 36, and a lower segment 52, which is located facing the segment 38. The segment 52 is symmetric to the segment 50, with respect to a horizontal plane passing through the center 8. The segment 50 corresponds to the strip of a sphere comprised between two horizontal planes that cut the sphere above its center. The center of this sphere is coincident with the center 8. The vertical distance between these two horizontal planes is, in this embodiment, smaller than the distance between the two horizontal planes that define the segment 36. Here, this vertical distance is chosen so that the whole of this segment 50 is able to bear against the segment 36, notably in the neutral position.

In the absence of external stress on the handle 4, the segment 50 is separated from the segment 36 by a clearance J (FIG. 1). This clearance J is larger than 0.05 mm or 0.1 mm and, preferably, larger than 0.2 mm or 0.3 mm. This clearance J is also generally smaller than 2 mm or 1 mm or 0.5 mm. In FIGS. 1 to 4, the clearance J corresponds to the thickness of the line separating the bearing faces 32 and 34.

The handle 4 also comprises a pusher 54 that is translatable along the axis 10 between a depressed position, which is shown in FIG. 4, and a rest position, which is shown in FIGS. 1 and 3. The pusher 54 comprises the shaft 22 and a slider 56. The pusher 54 may be moved from its rest position to its depressed position by a user, who, with his hand, pushes the shaft 22 into the body 6. Conversely, the pusher 54 automatically returns to its rest position as soon as the user releases the shaft 22. To this end, the lower portion 14 comprises a slide 58 that is arranged to allow the slider 56 to slide along the axis 10 of the handle 4. For example, the slide 58 is here a cylindrical hole that extends along the axis 10 and that passes right through the lower portion 14. By way of illustration, the cross section of this cylindrical hole is circular.

Correspondingly, the slider 56 is here an essentially cylindrical part accommodated inside the slide 58. The slider 56 has an upper end 60 and a lower end 62. The shaft 22 is fastened with no degree of freedom to the upper end 60. For example, the upper end 60 is located in the extension of the segment 36 of the bearing face 32. Thus, in the inclined position (FIG. 3), one portion of the end 60 is located facing the segment 50.

When the pusher 54 is in the rest position, the lower end 62 is located in the extension of the segment 38 of the bearing face. Thus, in the inclined position (FIG. 3), one portion of the lower end 62 is located facing the segment 52. Under these conditions, in the inclined position, the segment 52 forms a stop that prevents movement of the pusher 54 to its depressed position.

Here, the joystick 2 is arranged to permit movement of the pusher 54 to its depressed position solely when the handle 4 is in its neutral position. To this end, the body 6 comprises a housing 66 that comprises an upper aperture the opening of which faces the lower end 62 when the handle 4 is in its neutral position. As shown in FIG. 4, this housing 66 is able to accommodate the lower end 62 when the pusher 54 is in its depressed position. Here, this housing 66 is centered on the axis 20 and extends in the Z-direction. The dimensions of its cross section are slightly larger than the dimensions of the cross section of the lower end 62, in order to permit movement of the pusher 54 to its depressed position solely when the handle 4 is in its neutral position.

To automatically return the pusher 54 to its rest position, the latter is also equipped with a spring-based return mechanism. For example, this return mechanism comprises:

- a blind hole 70 formed inside the slider 56 along the axis 10,
- an oblong groove 74 that passes right through the slider 56 in the Y-direction,
- a rod 76 that passes right through the slider 56 in the groove 74, and
- a spring 78 interposed between a flat bottom 72 of the hole 70 and the rod 76.

The hole 70 opens into a lower end of the slider 56. The flat bottom 72 of the hole 70 is located on the opposite side to this lower end of the slider 56.

The groove 74 extends parallel to the axis 10 over a distance larger than or equal to the length of the travel of the pusher 54 between its rest and depressed positions. The groove 74 passes through the hole 70.

The rod 76 is fastened with no degree of freedom to the slide 58. When the pusher 54 is moved between its rest and depressed positions, this rod slides inside the groove 74. Thus, it does not hinder the movement of the pusher 54.

When the pusher 54 is moved to its depressed position, the spring 78 is compressed between the bottom 72 and the rod 76 and therefore stores potential energy. When the user releases the shaft 22, the spring 78 relaxes, thus automatically returning the pusher 54 to its rest position.

In this embodiment, to measure the angular position of the handle 4 with respect to the body 6 and to detect the depressed position of the pusher 54, the joystick 2 uses the same permanent magnet 80 and the same electronic circuit 82. The magnet 80 is fastened with no degree of freedom to the lower end 62. The electronic circuit 82 is housed inside the housing 66. This circuit 82 comprises a magnetic-field sensor 84. Typically, it is a question of a triaxial magnetometer. The circuit 82 is able, on the basis of the measurements taken by the sensor 84, to establish both the angular position of the handle 4 and to detect the depressed position of the pusher 54.

To prevent the handle 4 from being rotated on itself about the axis 10, the lower portion 14 comprises a pin 90 and the body 6 comprises a vertical groove 92. A left end of the pin 90 is slidably accommodated inside the groove 92. To this end, the width of the groove 92 is 1.05 times larger than the width of the left end of the pin 90. The left end of the pin 90 is also able to turn on itself inside the groove 92. For example, to this end, the cross section of this left end is circular.

The right end of the pin 90 is fastened with no degree of freedom to the lower portion 14 of the handle 4. For example, the pin 90 extends horizontally parallel to the X-direction when the handle 4 is in its neutral position. In this embodiment, the pin 90 lies in the horizontal plane containing the center 8. To this end, the rim 40 comprises a notch 94 (FIG. 2) for the passage of the pin 90.

When the handle 4 is inclined about an axis parallel to the Y-direction, the left end of the pin 90 slides inside the groove 92. When the handle 4 is inclined about an axis parallel to the X-direction, the left end of the pin 90 rotates on itself inside the groove 92. Thus, the pin 90 permits rotational movements of the handle 4 about every horizontal axis of rotation passing through the center 8. In contrast, if a user tries to rotate the handle 4 about the axis 10, the left end of the pin 90 abuts against a vertical face of the groove 92, thus blocking this rotation.

Here, the body 6 is mainly formed by an upper shell 100 and a lower shell 102. The shells 100 and 102 are joined to each other with no degree of freedom. The shell 100 has an aperture 103 that opens into the upper face 24 and that is centered on the axis 20. This aperture is passed through by the shaft 22. The wall of this aperture 103 is frustoconical and also serves as a stop for limiting the angular amplitude of the rotation of the handle 4 about the center 8.

The body 6 comprises a fixed horizontal border 104 that protrudes inside the body 6 and that is located facing the rim 40 when the handle 4 is in its neutral position. The border 104 is centered on the center 8 and practically encircles the axis 20 completely. Here, the border 104 is therefore essentially circular. In this embodiment, the border 104 is passed through by the groove 92. It therefore comprises a notch 110 (FIG. 2) for the passage of the left end of the pin 90.

Figure 2:
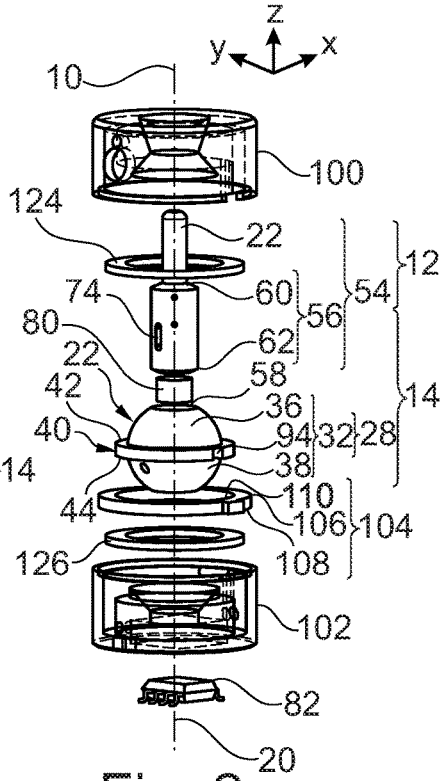
FIG. 2 is a schematic illustration, of an exploded perspective view, of the main elements of the joystick of FIG. 1.

The border 104 has an upper face 106 (FIG. 2) and a lower face 108 (FIG. 2). The face 108 is symmetric to the face 106, with respect to the horizontal plane containing the center 8. When the handle 4 is in its neutral position, the face 106 lies in a first horizontal plane and the face 42 of the rim 40 lies in a second horizontal plane. This first horizontal plane is either coincident with the second horizontal plane or located above this second horizontal plane. For example, the smallest distance separating these first and second horizontal planes is generally in a range between 0 mm and 1 mm or between 0 mm and 0.5 mm. For example, the border 104 is produced using a ring that is wedged between the shells 100 and 102 during assembly of these shells.

The joystick 2 comprises a mechanism for returning the handle 4 to its neutral position. This mechanism is here in addition designed to limit friction between the bearing faces 32 and 34 of the articulation 26. This mechanism comprises:

an upper set 120 and a lower set 122 of springs, and upper and lower movable annular plates 124, 126.

Here, the plates 124 and 126 are structurally identical. In the neutral position, the plate 126 is symmetric to the plate 124, with respect to a horizontal plane located midway between the faces 106 and 108 of the border 104. In this neutral position, the plate 124 lies in a horizontal plane. It also bears, all the way around the axis 20, directly against the face 106.

The plate 124 is rigid, i.e., made of a hard material in the Young's modulus at 20° C. and, for example, higher than 50 GPa or 100 GPa. In the neutral position, the plate 124 also extends above the face 42 of the rim 40. Here, the plate 124 is a metal annulus. Thus, when the handle 4 is inclined, one side of the face 42 bears directly on one side of the plate 124 and lifts this side of the plate 124 upward. The opposite side, with respect to the axis 10, of the plate 124 continues, for its part, to bear directly against the face 106 of the border 104. In other words, the plate 124 passes from a horizontal position, as shown in FIG. 1, to a tilted position, as shown in FIG. 3.

In the neutral position, the set 122 is symmetric to the set 120, with respect to the horizontal plane passing through the center 8. In addition, here, the sets 120 and 122 are structurally identical. In particular, the stiffness and the length of the sets 120 and 122 are identical to within manufacturing tolerances.

The set 120 is interposed between the body 6 and the faces 42 and 106. More precisely, the set 120 bears directly, on an upper side, against the shell 100 and, on the opposite side, against the plate 124. The set 120 may comprise one or more springs uniformly distributed about the axis 20. In this embodiment, the sets 120 and 122 each comprise a single coil spring, 128 and 130, respectively.

The central axis of the spring 128 coincides with the axis 20. The length of the spring 128 is adjusted so that, in the neutral position, it permanently urges the plate 124 against the face 106. Typically, springs 128 and 130 are preloaded. Thus, as soon as the handle 4 is moved away from its neutral position, a return force appears. In the inclined position of the handle 4, and therefore in the tilted position of the plate 124, the spring 128 is compressed asymmetrically with respect to the axis 20. For example, in the case of the inclined position shown in FIG. 3, the spring 128 is much more compressed on the left side than on the right side. The vertical force $F_1$ exerted by the spring 128 on the left side of the face 42 is therefore greater than the vertical force exerted on the right side of the same face 42. Under these conditions, the spring 128 creates a mechanical moment with respect to the center 8 that tends to return the handle 4 to its neutral position. Simultaneously, the vertical force $F_1$ pushes the segment 38 of the bearing face 32 toward the segment 52 of the bearing face 34. However, this vertical force $F_1$ is compensated, and ideally canceled out, by a vertical force $F_2$ created at the same time by the lower spring 130. Specifically, in the inclined position of FIG. 3, the right side of the spring 130 is much more compressed than its left side. This generates on the rim 40 the vertical force $F_2$. Since the spring 130 is symmetric to the spring 128, the vertical force $F_2$ is of opposite direction to the force $F_1$ and of substantially equal amplitude to the vertical force $F_1$ exerted at the same time. Here, the amplitudes of the forces $F_1$ and $F_2$ are considered to be substantially equal if the amplitude of the force $F_2$ is comprised between $0.9|F_1|$ and $1.1|F_1|$ and, preferably, between $0.95|F_1|$ and $1.05|F_1|$, where $|F_1|$ is the amplitude of the force $F_1$. Thus, the spring 130 considerably reduces the force that tends to press the segment 38 against the segment 52. Consequently, the friction between these two segments 38, 52 of the bearing faces of the articulation 26 is very greatly decreased.

At the same time, the spring 130 also generates a mechanical moment about the center 8 that tends to move the handle 4 toward its neutral position. Thus, the spring 130 does not oppose the return of the handle 4 to its neutral position but, on the contrary, contributes to this movement.

The springs 128 and 130 are also arranged to maintain, in the absence of external force on the handle 4, the male portion 28 of the articulation 26 centered on the center 8. Thus, in the absence of vertical force on the handle 4, the bearing faces 32 and 34 are mechanically separated from each other by the clearance J. Therefore, if an external force exerted on the handle 4 tends to press either the segments 36 and 50 or the segments 38 and 52 against each other, the vertical forces exerted by the springs 128 and 130 together oppose this external force. This limits friction.

Figure 5:
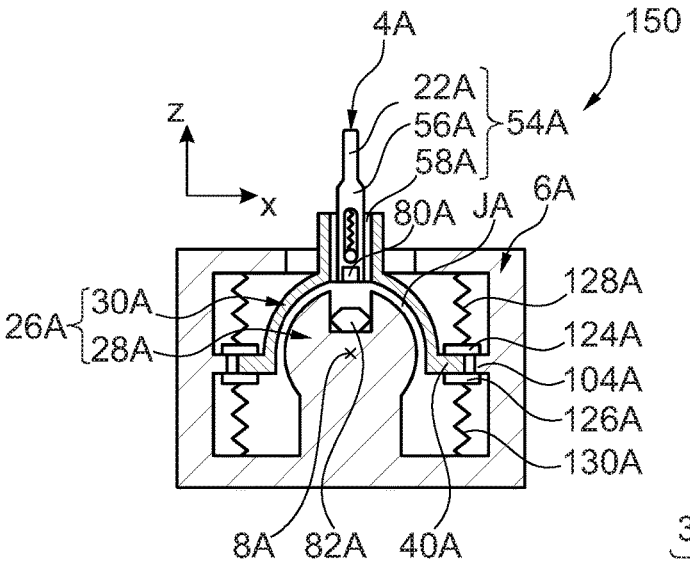
FIGS. 5 to 7 are schematic illustrations, in vertical cross section, of various other possible embodiments of the joystick of FIG. 1.
Figure 6:
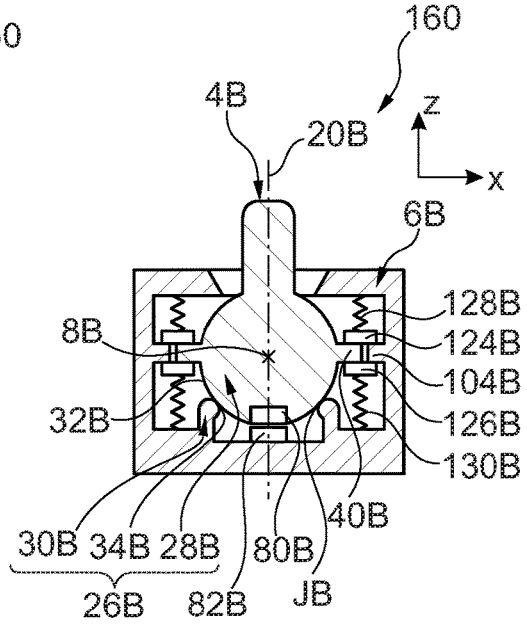
Figure 7:
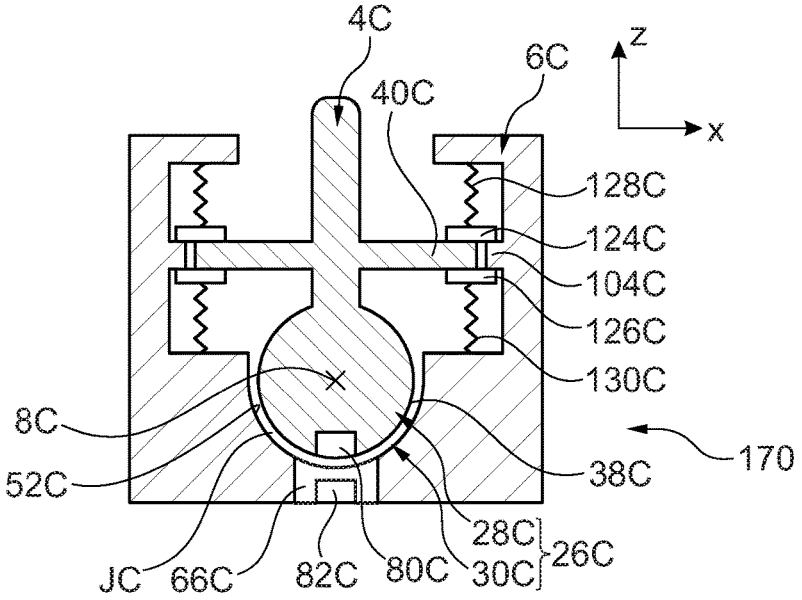

FIGS. 5 to 7 schematically show various other possible embodiments of a joystick in which friction is decreased using the same principle as that described with reference to FIGS. 1 to 4. In these figures, each element that performs the same function as a corresponding element of the joystick 2 has been designated with the same reference number followed by the letters A, B and C, in the embodiments of FIGS. 5, 6 and 7, respectively. In addition, to simplify FIGS. 5 to 7, certain structural details that were shown in the case of the joystick 2 have been omitted from these figures. For example, the pin 90 and the groove 92 have not been shown. Below, only the main differences between these embodiments of FIGS. 5 to 7 and the joystick 2 are described.

FIG. 5 shows a joystick 150. The main difference between the joystick 150 and the joystick 2 is that the male portion 28A is fastened with no degree of freedom to the body 6A and the female portion 30A is integral with the handle 4A.

FIG. 6 shows a joystick 160. The following are the main differences between the joysticks 160 and 2:

- the handle 4B is devoid of pusher;
- the bearing faces 32B, 34B of the male and female portions 28B, 30B, respectively, of the articulation 26B are solely located under a horizontal plane passing through the center 8B, and
- the bearing face 34B does not comprise a spherical segment but is limited to a thin annular bearing band (e.g., as the bearing face 34B) that is centered on the vertical axis 20B.

The positions of the bearing faces 32B, 34B of the joystick 160 permit an upward translational movement of the handle 4B against the return forces of the spring 128B. However, in certain embodiments, it is not necessary to block such a translational movement of the handle 4B.

In the embodiment of FIG. 6, the bearing face 34B is much smaller than in the joystick 2. This allows the friction between the bearing faces 32B, 34B of the male and female portions 28B, 30B to be further decreased.

FIG. 7 shows a joystick 170. The following are the main differences between joysticks 170 and 2:

- the handle 4C is devoid of pusher;
- the bearing faces 32C (with segment 38C) and 34C (with segment 52C) are entirely located under the horizontal plane passing through the center 8C, and
- the rim 40C is no longer located level with the articulation 26C, but above this articulation 26C.

This embodiment shows that it is possible to produce the rim 40C elsewhere than in the lower portion of the handle 4C.

Section II: Variants

Variants of the Pusher:

As a variant, in the depressed position, the lower end of the pusher 54 does not protrude beyond the segment 38 of the bearing face 32. In other words, in the depressed position, the lower end 62 is recessed inside the lower portion 14. Under these conditions, the segment 52 of the bearing face 34 no longer serves as a stop able to prevent the movement of the pusher 54 to its depressed position. Thus, the pusher 54 may be moved between its rest and depressed positions regardless of the angular position of the handle 4.

In another embodiment, additional housings, which are angularly offset with respect to each other around the center 8, are provided so as to obtain additional angular positions of the handle 4 in which the pusher 54 is able to be moved to its depressed position.

The cross section of the housing 66 may also be increased to permit other angular positions of the handle 4 in which the movement of the pusher 54 toward its depressed position is permitted.

In one simplified embodiment, the pusher 54 is omitted. In this case, the slider 56 and the slide 58 are omitted.

Variants of the Articulation:

As a variant, the segments 36, 38 and/or the segments 50, 52 are not symmetric.

In one simplified embodiment, the bearing faces 32, 34 of the male and female portions 28, 30 of the articulation 26 are solely located on one side of the horizontal plane, passing through the center 8. For example, the segments 36 and 50 are omitted.

In one particular embodiment, the handle 4 is solely able to pivot about a single horizontal axis of rotation. In this case, the articulation 26 may be replaced by an articulation that solely performs the function of a revolute joint. By way of illustration, to this end, the spherical bearing faces are replaced by cylindrical bearing faces the generatrices of which are parallel to the desired axis of rotation.

Variants of the Sets of Springs:

Many different embodiments are possible for the upper and lower sets 120, 122 of springs. For example, one or more elastomeric pads can be used to form the sets 120, 122 of springs. It is also possible to use leaf springs or the like instead of coil springs.

As described above, to limit friction, when the handle 4 pivots about a first axis parallel to the Y-direction, the vertical force $F_1$ exerted by the set 120 on the handle 4 is compensated for by the vertical force $F_2$. The same goes when the handle 4 pivots about a second axis parallel to the X-direction. In contrast, it is not necessary for the amplitudes of the vertical forces $F_1$ and $F_2$ to be equal in these two situations. For example, as a variant, the amplitudes of the vertical forces $F_1$ and $F_2$ when the handle 4 pivots about the first axis are higher than the amplitudes of the vertical forces $F_1$ and $F_2$ when the handle 4 pivots about the second axis. This is possible if, for example, the sets 120 and 122 each comprise:

- first and second springs each located on one respective side of a first vertical plane passing through the center 8 and parallel to the Y-direction; and
- third and fourth springs each located on one respective side of a second vertical plane passing through the center 8 and parallel to the X-direction.

The first and second springs have a stiffness at least 1.1 times or 1.2 times higher than the stiffness of the third and fourth springs. In this case, the force to be exerted by the user to make the handle 4 pivot about the first axis is greater than the force required to make the handle 4 pivot about the second axis. It is therefore possible to create directions in which it is easier to pivot the handle 4 while nonetheless limiting friction.

In the neutral position, the sets 120 and 122 are not necessarily symmetric with respect to a horizontal plane passing through the center 8. For example, the spring 130 is replaced by a spring of identical stiffness, but the diameter of which is 1.1 times smaller or 1.1 times larger than that of the spring 128.

In another embodiment, the springs 128 and 130 are not preloaded. Thus, they do not oppose small movements of the handle 4 about its neutral position.

As a variant, each set 120, 122 comprises a plurality of coil springs, which are, for example, uniformly distributed around the vertical axis 20.

Other Variants:

It is possible to measure the angular position of the handle 4 and to detect the position of the pusher 54 using different sensors. For example, the joystick comprises a sensor dedicated to measuring the angular position of the handle 4 and another sensor dedicated to measuring the position of the pusher 54. In this case, the sensors used do not need to be based on the same technologies. Thus, it is possible to use a mechanical sensor to detect one or more angular positions of the handle 4, instead of a magnetic sensor. Likewise, a mechanical sensor may also be used to detect the depressed position of the pusher 54. In another example, it is possible to use a magnetic sensor solely to measure the angular position of the handle 4 and another magnetic sensor solely to detect the depressed position of the pusher 54.

In another embodiment, the position of the permanent magnet 80 and of the circuit 82 is inverted. In this case, the permanent magnet is fastened to the body 6 and the circuit 82 is fastened to the handle 4.

The number of axes about which the handle 4 is able to pivot may be limited. For example, the joystick may comprise additional mechanical stops that limit the number of directions in which it is possible to move the shaft 22. Thus, the number of horizontal axes about which the handle 4 is able to pivot may be made lower than or equal to 4, 3, 2 or 1.

If it is not necessary to precisely locate the neutral position, the border 104 may be omitted.

In one simplified embodiment, the movable plates 124 and 126 are omitted. In this case, the ends of the springs 128 and 130 bear directly against the faces 106 and 108 in the neutral position and against the faces 42 and 44 in the inclined position.

The shaft 22 may be replaced by another means for gripping the handle 4 such as a knob, a button, a cursor, inter alia. In another variant, the shaft 22 is not moved by a human being but by a robot.

The various variants described here may be combined.

Section III: Advantages of the Described Embodiments

The sets 120 and 122 permanently urge the handle 4 to an equilibrium position in which, in the absence of vertical force exerted on the handle 4, the clearance J between the bearing faces of the articulation 26 exists. Under these conditions, the sets 120, 122 oppose any vertical force that tends to press the bearing faces 32, 34 against each other. This limits the friction between these bearing faces 32, 34 and limits wear of the articulation 26. In addition, these sets 120, 122 simultaneously perform the function of returning the handle 4 to its neutral position. In particular, both the set 120 and the set 122 exert a moment that tends to return the handle 4 to its neutral position. Thus, for a given return force exerted on the handle 4, the dimensions of the springs of these sets 120, 122 may be decreased with respect to the case where only one of these sets 120, 122 exerts this return force. Lastly, the manufacture of the joystick is simplified since it is the same sets 120, 122 of springs that perform both the function allowing friction to be limited and the function of returning the handle 4 to its rest position.

The border 104 against which the sets 120, 122 bear in the neutral position allows the location of this neutral position to be precisely located. Specifically, the location of the border 104 with respect to the body is set and independent of the characteristics of the springs used. When this border 104 is omitted, the location of the neutral position depends on the characteristics of the springs. However, in practice, because of manufacturing errors, the springs of the sets 120, 122 are not always exactly identical. Thus, the neutral position of every manufactured joystick is not necessarily the same. In other words, there would be imprecision in the location of this neutral position. The presence of the border 104 allows this imprecision to be greatly limited.

The use of the plates 124 and 126 allows springs that bear simultaneously against the faces of the rim 40 and, alternately, against the border 104 to be obtained.

The use of the same magnet and of the same sensor to determine the position of the pusher 54 and the angular position of the handle 4 simplifies the production of the joystick.

The housing 66 allows the number of angular positions of the handle 4 in which the pusher 54 may be moved into its depressed position to be limited. To achieve this, the same bearing face 32 performs not only the function of a bearing face for the articulation 26, but also the function of a stop preventing the movement of the pusher 54 to its depressed position. Production of the joystick 2 is therefore simplified.

The fact that the housing 66 is centered on the vertical axis 20 allows the pusher 54 to be depressed solely when the handle 4 is in its neutral position.

The fact that the bearing faces 32, 34 extend both above and below the horizontal plane containing the center 8 allows any translation movement of the handle inside the body 6 to be prevented.

The invention claimed is:

1. A joystick comprising:

a fixed body;

a handle that extends along an axis of the handle from an upper portion to a lower portion that is accommodated inside the fixed body, the upper portion being accessible from outside the body and allowing the handle to be rotated between a neutral position and an inclined position, the neutral position being the position of the handle in the absence of external stress on the handle;

an articulation comprising a male portion and a female portion, one of the male portion and of the female portion being fastened with no degree of freedom to the lower portion of the handle, and the other of the male portion and of the female portion being fastened with no degree of freedom to the fixed body, and in which:

the male and female portions comprise corresponding and facing bearing faces, these bearing faces being shaped to permit, via shape-shape interaction when they rub against each other, a rotational movement of the handle about one or more axes of rotation that are fixed with respect to the body and perpendicular to the axis of the handle; and the handle comprises a first rim that is integral with the handle, this rim having, on each side of the handle, an upper face that is turned toward the upper portion of the handle and a lower face that is turned toward the lower portion of the handle; and a first set of springs that is interposed between the fixed body and the upper face of the rim, this first set of springs comprising one or more springs that are uniformly distributed around a vertical axis, this vertical axis being coincident with the axis of the handle when the handle is in the neutral position, and this first set of springs being arranged so as to exert, on the handle, in its inclined position, a mechanical moment that urges the handle toward its neutral position and, at the same time, a first vertical force, parallel to the vertical axis, that pushes the bearing face that is integral with the handle toward the bearing face that is integral with the body; and wherein:

the joystick further comprises a second set of springs that is interposed between the fixed body and the lower face of the rim, this second set of springs comprising one or more springs that are uniformly distributed around the vertical axis, this second set of springs being arranged so as to exert, on the handle, in the inclined position, a mechanical moment that urges the handle toward the neutral position and, at the same time, a second vertical force, parallel to the vertical axis, of direction opposite to the first vertical force and the amplitude of which is comprised between $0.9|F_1|$ and $1.1|F_1|$, where $|F_1|$ is the amplitude of the first vertical force exerted by the first set of springs in the same inclined position, and the first and second sets of springs are able, in the absence of external stress on the handle in a direction parallel to the vertical axis, to maintain a non-zero clearance between all the bearing faces of the articulation.

2. The joystick of claim 1, wherein:

the joystick further comprises a border that is integral with the body, this border having, on each side of the vertical axis, an upper face that is turned toward the upper portion of the handle and a lower face that is turned toward the lower portion of the handle;

the upper face of the border is located in the same horizontal plane as the plane that contains the upper face of the rim when the handle is in its neutral position or above this horizontal plane in a direction directed from the lower portion to the upper portion of the handle, the horizontal plane being perpendicular to the vertical axis;

the lower face of the border is located in the same horizontal plane as the plane that contains the lower face of the rim when the handle is in its neutral position or below this horizontal plane;

the first set of springs is also interposed between the body and the upper face of the border so as to bear against the border in the neutral position of the handle; and the second set of springs is also interposed between the body and the lower face of the border so as to bear against the border in the neutral position of the handle.

3. The joystick of claim 2, wherein the joystick further comprises:

a first movable plate that bears, on one side, against one end of the one or more springs of the first set and that bears, on the opposite side, against the upper face of the rim, when the handle is in its inclined position, and against the upper face of the border when the handle is in its neutral position; and a second movable plate that bears, on one side, against one end of the one or more springs of the second set and that bears, on the opposite side, against the lower face of the rim, when the handle is in its inclined position, and against the lower face of the border when the handle is in its neutral position.

4. The joystick of claim 1, wherein the joystick further comprises:

a slide that extends along the axis of the handle; and a pusher that is able, by sliding inside the slide, to move between a rest position and a depressed position.

5. The joystick of claim 4, wherein the joystick further comprises:

a permanent magnet and a magnetic-field sensor, one of the permanent magnet and of the magnetic-field sensor being fastened with no degree of freedom to the pusher and the other of the permanent magnet and of the magnetic-field sensor being fastened with no degree of freedom to the body; and an electronic circuit able to:

acquire the measurements of the sensor, and determine, from these acquired measurements, both a position of the pusher and an inclination of the handle.

6. The joystick of claim 4, wherein:

the body comprises a housing able to accommodate a lower end of the pusher when the latter is in its depressed position; and the bearing face that is integral with the body encircles the aperture of this housing that is turned toward the pusher, this bearing face thus forming a stop that is able to prevent the movement of the pusher to its depressed position when the lower end of the pusher is not directly opposite the aperture of this housing.

7. The joystick of claim 6, wherein the housing is centered on the vertical axis and the body has no other housing able to accommodate the lower end of the pusher in its depressed position.

8. The joystick of claim 1, wherein the bearing faces of the male and female portions of the articulation are segments of first and second concentric spheres, respectively.

9. The joystick of claim 1, wherein the stiffness of the one or more springs of the second set is equal to within plus or minus 10% to the stiffness of the one or more springs of the first set.

* * * * *